US010010202B2

(12) United States Patent
Flocchini

(10) Patent No.: US 10,010,202 B2
(45) Date of Patent: Jul. 3, 2018

(54) NAPKIN HOLDER

(71) Applicant: Andrew Flocchini, Petaluma, CA (US)

(72) Inventor: Andrew Flocchini, Petaluma, CA (US)

( * ) Notice: Subject to any disclaimer, the term of this patent is extended or adjusted under 35 U.S.C. 154(b) by 17 days.

(21) Appl. No.: 15/150,212

(22) Filed: May 9, 2016

(65) Prior Publication Data

US 2016/0324348 A1 Nov. 10, 2016

Related U.S. Application Data

(60) Provisional application No. 62/158,151, filed on May 7, 2015.

(51) Int. Cl.
*A47G 21/16* (2006.01)

(52) U.S. Cl.
CPC ..... *A47G 21/16* (2013.01)

(58) Field of Classification Search
CPC ..... A47G 21/16; A47G 21/00; A47G 23/06; A47G 11/001; A47K 10/421; Y10T 24/1312; B65D 75/54; A47F 7/14; A47F 7/0014; A47F 7/163; A47F 5/005; A47F 7/0042; A47F 7/0007; A47F 7/141; A47B 65/00; A47B 81/067; G09F 1/10; G09F 5/04
USPC .... 211/45–55, 11, 41.1, 41.12, 49.1, 42, 72, 211/126.2, 126.16, 126.13, 73, 85.4; D7/631, 632, 634; D6/631, 407; 206/553, 449, 494, 233, 499, 308.1, 557; D19/90, 91, 92; 24/7; 312/9.9; 40/124.2, 124; 221/285, 67
See application file for complete search history.

(56) References Cited

U.S. PATENT DOCUMENTS 1,008,124 A * 11/1911 Dudley ..... A47L 19/04 211/40
1,354,026 A * 9/1920 Cox ..... G09F 23/06 211/73
1,511,812 A * 10/1924 Horwitt ..... A47K 10/423 211/51
1,686,862 A * 10/1928 King ..... A47G 21/16 211/50
D76,874 S * 11/1928 King ..... D7/631
D86,168 S * 2/1932 Heusser ..... 273/148 A
1,985,561 A * 12/1934 Colwell ..... A47G 21/16 211/50
D160,088 S * 9/1950 Hutzler ..... D7/634
3,405,810 A * 10/1968 Rogus ..... B65D 21/048 206/507
3,561,595 A * 2/1971 Weggeland ..... G11B 23/0236 206/387.1
3,746,296 A * 7/1973 Dean ..... A47B 65/00 211/43

(Continued)

*Primary Examiner* — Hiwot E Tefera
(74) *Attorney, Agent, or Firm* — Craig M. Stainbrook; Stainbrook & Stainbrook, LLP

(57) ABSTRACT

A napkin holder including a base and a plurality of sides connected to the base and extending upwardly therefrom, wherein the sides are configured to induce rotation of a napkins in a stack of napkins dropped in a vertical orientation into said holder, the rotation proceeding a first direction on one side of the napkin stack and in an opposing direction on the other side of the napkin stack, such that the individual napkins are at least partially displaced from one another and presented in a fanned array, thereby facilitating selection and removal of individual napkins.

15 Claims, 6 Drawing Sheets

(56) References Cited

U.S. PATENT DOCUMENTS

| | | | | |
|---|---|---|---|---|
| 4,454,950 | A * | 6/1984 | Stefanelli | A47B 43/00 211/195 |
| 6,082,553 | A * | 7/2000 | Stravitz | A47B 63/00 206/308.1 |
| 6,227,384 | B1 * | 5/2001 | Saylor | A47B 17/033 211/11 |
| 6,321,929 | B1 * | 11/2001 | Weshler | A45C 3/04 206/217 |
| 7,510,089 | B2 * | 3/2009 | Killinger | B42F 7/145 211/11 |
| 9,060,633 | B1 * | 6/2015 | Fiola | A47G 21/16 |
| 2011/0127261 | A1 * | 6/2011 | Levie | A47G 19/32 220/23.87 |

* cited by examiner

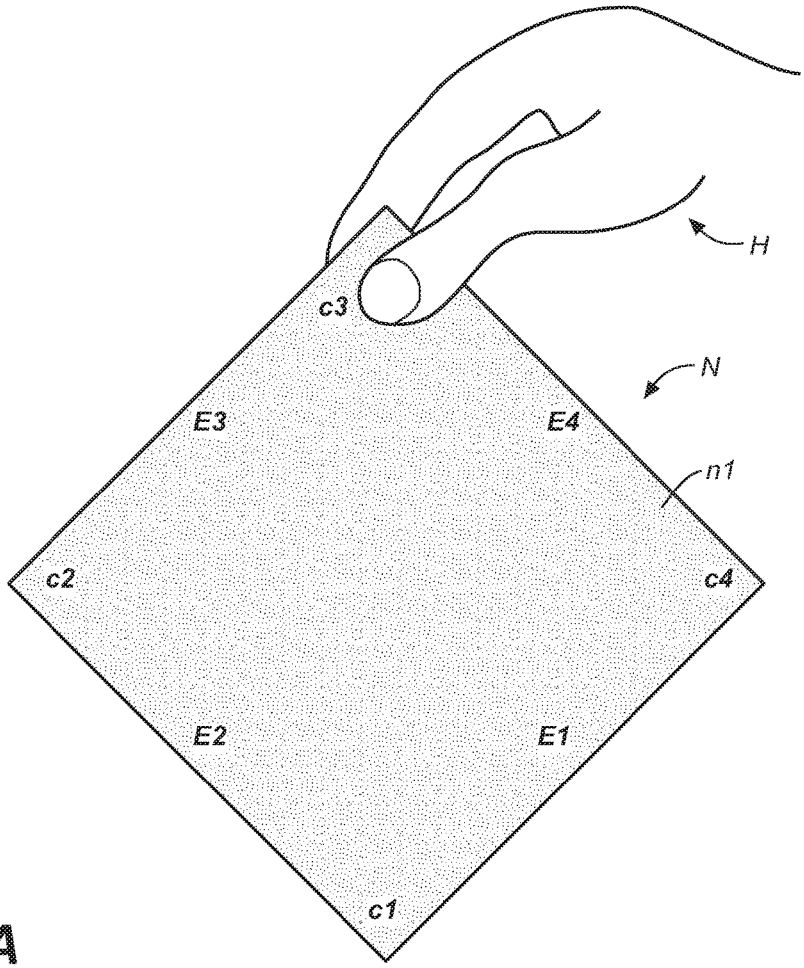
FIG. 3A
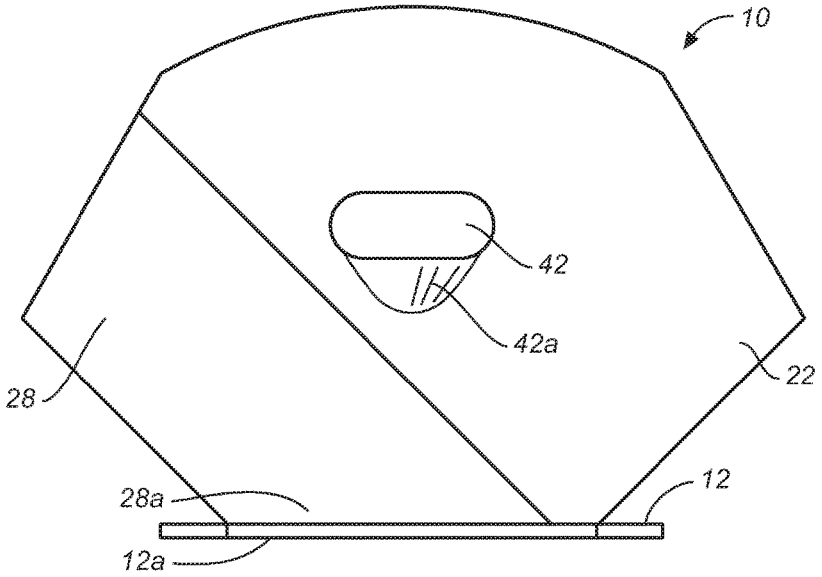

NAPKIN HOLDER

CROSS REFERENCES TO RELATED APPLICATIONS

The present application claims priority to, and the benefit of the filing date of, U.S. Provisional Patent Application Ser. No. 62/158,151, filed May 7, 2015, incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Field of the Invention

The present invention relates generally to napkin holders for use by consumers in their home locations and by patrons of commercial dining establishments in restaurants and other commercial dining facilities. The invention relates more particularly to a novel way of storing and presenting napkins in an aesthetically pleasing way and of dispensing the same napkins in simple and easy manner.

Background Discussion

Paper napkins are in common use in households and eating establishments. The present invention pertains to square and rectangular napkins that are sold in a stacked format and are usually stored and dispensed in that orientation. Separating (individuating) stacked napkins is a well-known problem. Many napkin holders are simple containers (usually metal) that retain the napkins in a rectangular cuboid box with a spring-biased panel that urges the stack toward a dispensing window. A user pulls on an exposed flap of napkin material to select and extract a napkin from the napkin holder. But as diners well know, it is evidently an irresistible temptation to overload this kind of napkin holder and thereby to create a tightly packed stack that renders the removal process one of tugging and tearing the napkin rather than gently pulling it from the container.

Other holders may comprise hoppers that conform to the profile of the napkin stack and rely on a weight or the stack weight itself to urge the napkins to a slot at the bottom of the hopper, where napkins can be removed.

These common napkin holding and dispensing devices make it difficult to remove an individual napkin. This characteristic results in lots of wasted of napkins (thus wasted paper). Additionally the dispensers are difficult and time-consuming to load.

The napkin holder of the present invention resolves the foregoing problems. It easily and efficiently orients napkins on edge in a decorative and splayed (fanned out) arrangement that facilitates retrieval of individual napkins. Further, the inventive napkin holder has no moving parts and does not apply pressure to the napkin stack. These are important but non-limiting features of the present invention provided so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF SUMMARY OF THE INVENTION

The present invention is a napkin holder that includes a base having a generally planar bottom adapted for placement on a flat horizontal surface. First and second substantially parallel opposing vertical sides are connected to and extend vertically upward from the base and are substantially perpendicular to the bottom of the base. First and second inclined opposing sides are disposed between and connect the first and second vertical sides. The first and second inclined sides converge at their respective bottom ends and terminate at the base to form a V-shaped trough enclosed by the first and second vertical sides. The configuration induces rotation of a napkins in a stack of napkins dropped in a vertical orientation into the holder. The rotation proceeds in a first direction on one side of the napkin stack and in an opposing direction on the other side of the napkin stack, such that the individual napkins are at least partially displaced from one another and presented in a fanned array, thereby facilitating selection and removal of individual napkins.

BRIEF DESCRIPTION OF THE SEVERAL VIEWS OF THE DRAWINGS

The invention will be better understood and its various objects and advantages will be understood when consideration is given to the following detailed description thereof. Such description makes reference to the annexed drawings wherein:

FIG. 3A is a side elevational view of the inventive napkin holder shown in FIG. 2A with a stack of napkins being held above the holder;

DETAILED DESCRIPTION OF THE INVENTION

Figure 1:
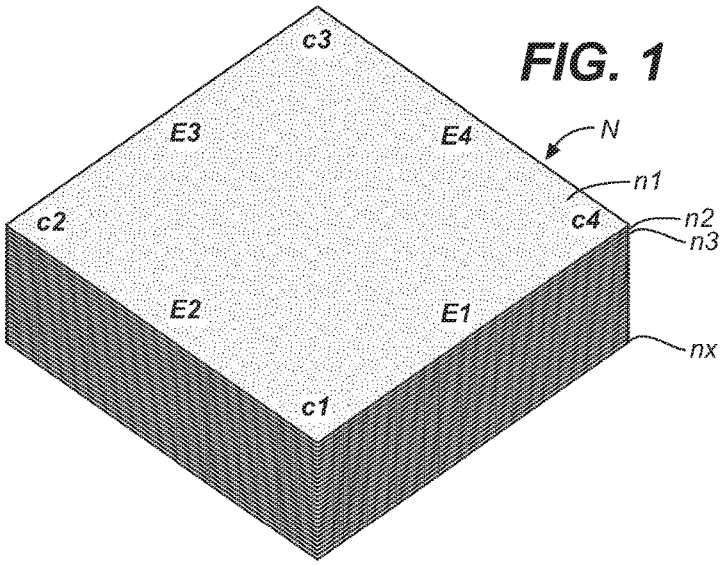
FIG. 1 is a perspective view of a stack of rectangular napkins.
Figure 2A:
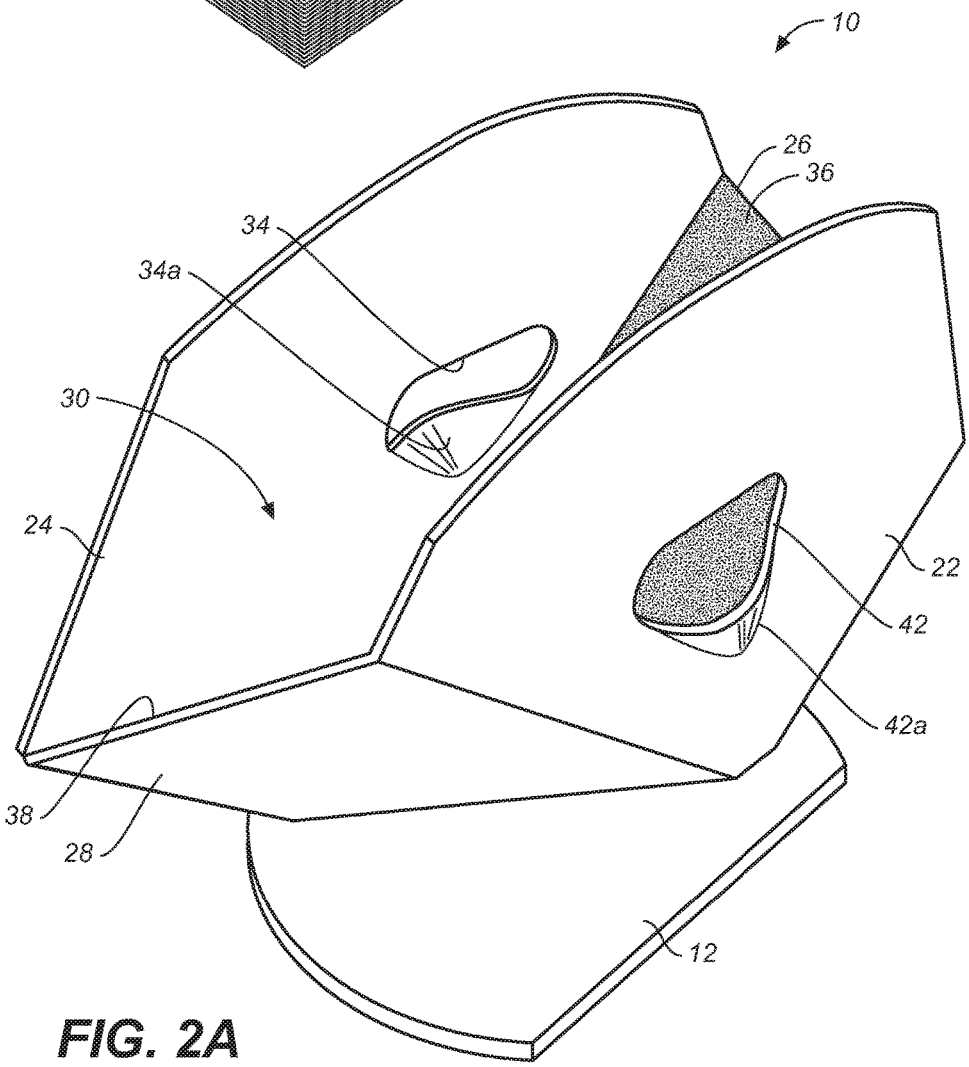
FIG. 2A is an upper perspective view of the inventive napkin holder.
Figure 2B:
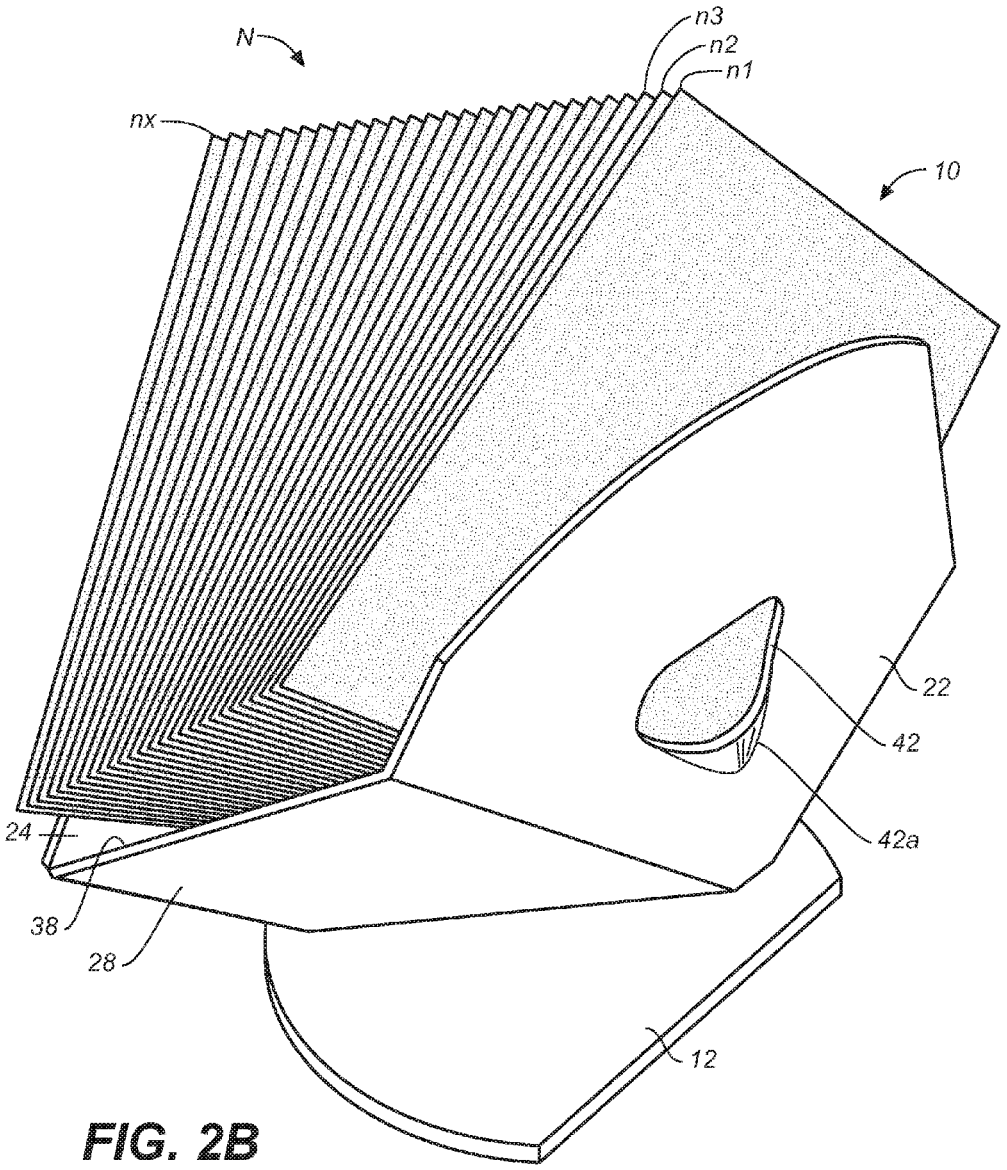
FIG. 2B is an upper perspective view of the inventive napkin holder with napkins present.

Referring to FIGS. 1 through 6, wherein like reference numerals refer to like components in the various views, there is illustrated therein a new and improved napkin holder, generally denominated 10 herein.

The napkin holder of the present invention 10 preferably has a base 12 with a generally planar bottom side 12*a* adapted for placement on a horizontally oriented flat surface, such as table top or countertop. The napkin holder base holds and supports four connected sides. Two of the napkin holder sides 22 and 24 are opposed and substantially parallel to one another, vertically oriented, perpendicular to the base 12, and separated by two inclined sides 26 and 28. The bottoms 26*a* and 28*a*, respectively, of each of the inclined sides 26, 28, converge and terminate at the base 12 to form a V-shaped trough 30 ("V-trough") that is closed by the vertical sides 22 and 24. The convergence/connection of the inclined sides 26 and 28 to the vertical side members 22 and 24 forms an acute angle 32 on one edge and an obtuse angle 34 on the other edge. This can best be seen in FIG. 4. On the interior of the V-trough 30 the inclined sides 26 and 28 have an upper laminated friction surface 36 and 38. The friction surface could be an abrasive such as sand paper or rubber, or could be incorporated in and integral to the material from which the inclined side is made by having a rough surface treatment.

Referring to FIG. 1, a stack of napkins N comprises individual napkins n1 to nx, with n1 nominally on top of the stack and nx at the bottom. In this instance the rectangular napkins are square in plan with the four sides being denominated as E1 thru E4 and the corners as c1 thru c4.

Figure 3B:
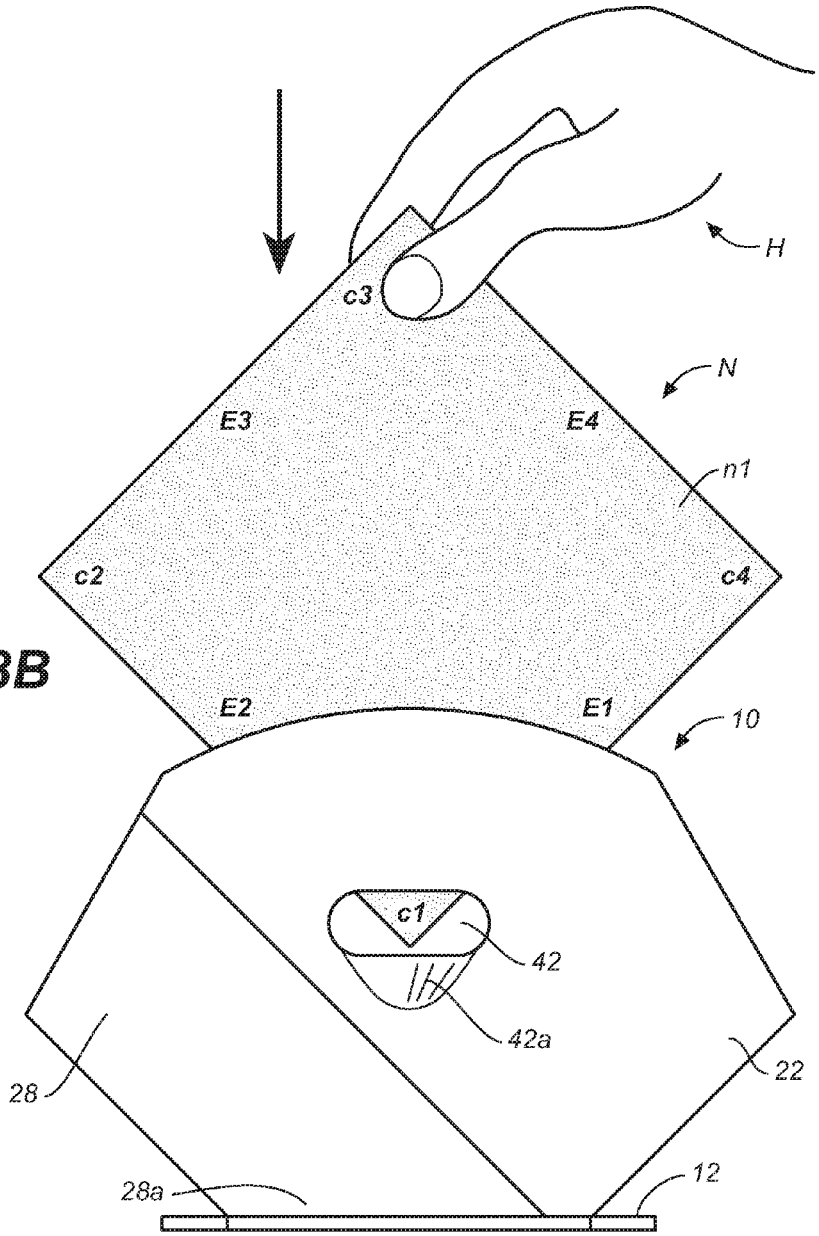
FIG. 3B is a side elevational view of the inventive napkin holder shown in FIG. 2A with a stack of napkins being held and partially inserted into the holder.
Figure 4:
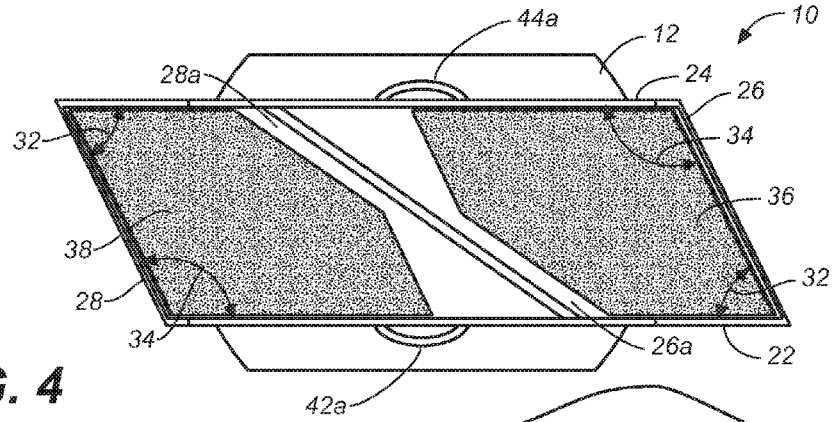
FIG. 4 is top plan view of the inventive napkin holder shown in FIG. 2A.
Figure 3C:
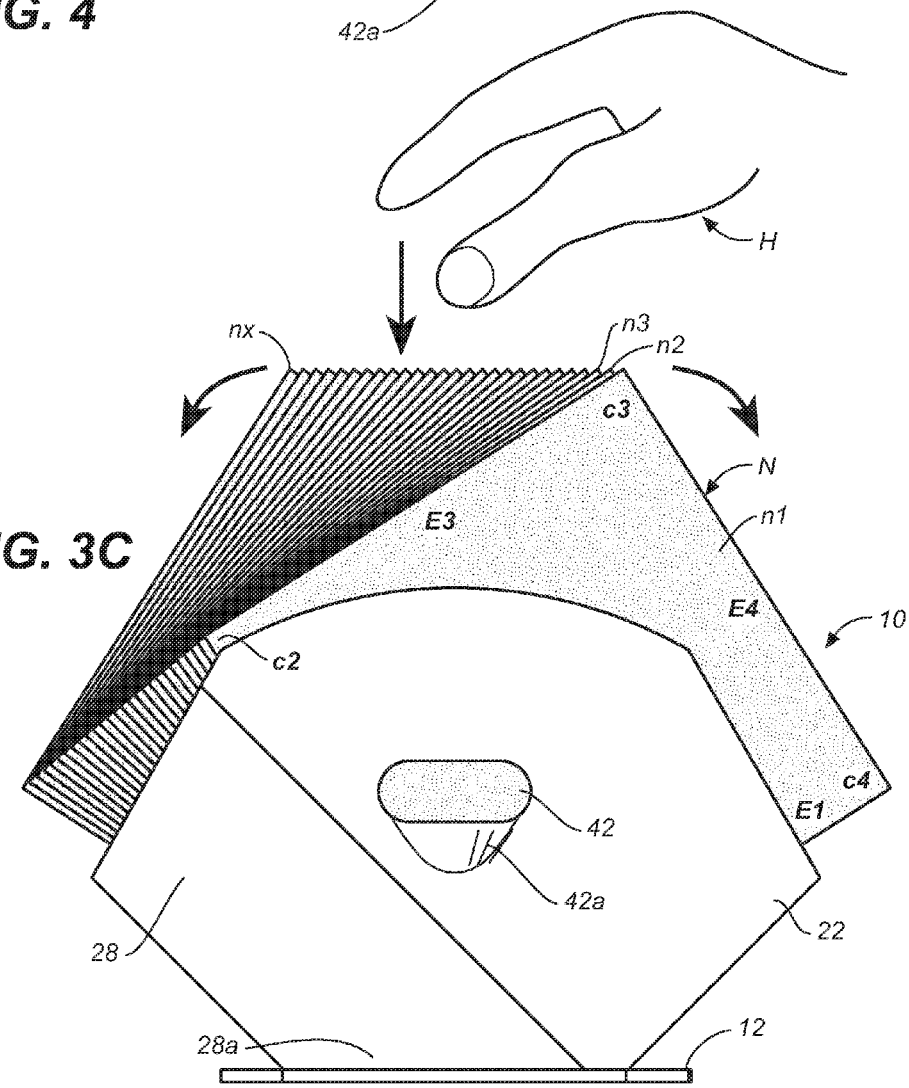
FIG. 3C is a side elevational view of the inventive napkin holder shown in FIG. 2B where a stack of napkins has been released and dropped into the holder.
Figure 5:
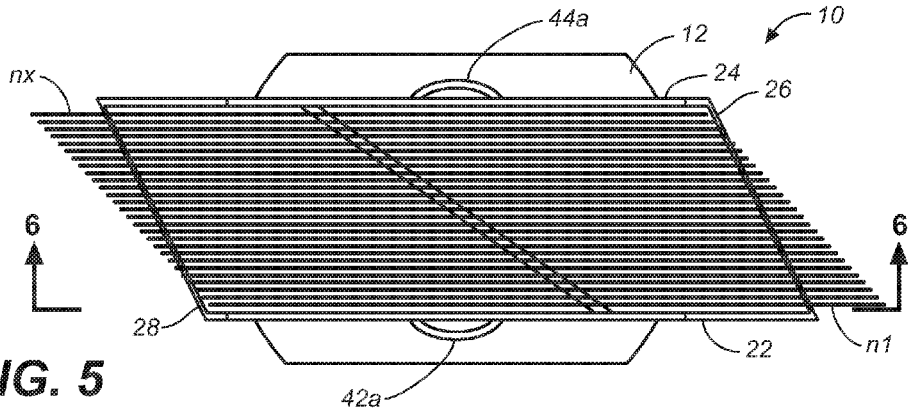
FIG. 5 is top plan view of the inventive napkin holder shown in FIG. 2B with napkins present.
Figure 6:
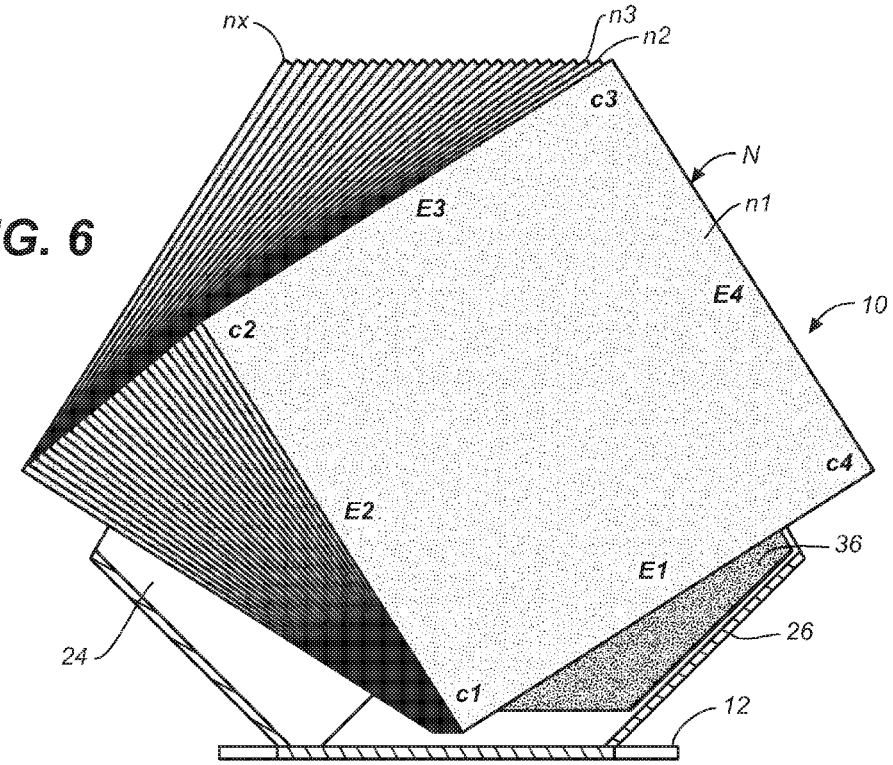
FIG. 6 is a cross-sectional side view taken along section line 6-6 in FIG. 5 of the inventive napkin holder shown in FIG. 3C with napkins present.

In practice, and looking now at FIG. 3A, a stack of napkins N is held at a corner above the inventive napkin holder 10, in this instance by a hand H at corner c3. In FIGS. 3A thru 3C the napkin stack N, corner c1 with adjacent edges E1 and E2, is lowered and introduced to the V-trough 30 of napkin holder 10. The vertical sides 22 and 24 contain apertures 42 and 44 respectively. The bottom edge of the apertures 42 and 44 are pushed out, thereby creating a sloped projection 42*a* and 44*a* in the vertical sides or walls 22 and 24. The outward slope of the bottom edge of the apertures prevents the napkin corners from leaving the V-trough area through the apertures. The napkin stack N is lowered until the corner c1 can be seen in the aperture 42 and at that point the lowering stops and the napkins are released, allowing them to fall. The napkin stack N falls as one unit until the outboard leading edge E2 of napkin n1 and leading edge E1 of napkin nx make first contact with the inclined friction surfaces 38 and 36 respectively. The outboard napkins n1 and nx momentarily stop at their leading edge as the napkin stack N continues to fall. The descent of the napkin stack imparts a slight rotation to the outboard napkins, since only one edge is stopped and the other is not yet in contact with the friction surface. When the leading edge E2 of the next napkin n2 encounters the friction surface 38, napkin n2 begins to rotate. Then the same forces act on napkin n3 and so on in succession until the center of the napkin stack encounters a friction surface. The cascading sequence of falling, contacting a friction surface, and rotating also occurs from the opposite (nx) side of the stack until it too is depleted of napkins to the middle of the stack. Once all of the leading edges have contacted a friction surface the stack stops its descent. The napkins in the stack are thus forced into an orientation relative to one another that is slightly displaced from each other (rotated about their centers in a splayed fashion, much like fanning a deck of cards), such that individual napkins can easily be visualized and manually selected from the stack. The inventive holder secures the napkins without applying pressure to the napkins so they are not predisposed to come out of the holder in small bunches or groups.

The inventive napkin holder may include a plurality of V-troughs to accommodate larger quantities of napkins. The V-troughs may also be of different sizes so that one dispenser can accommodate napkins of different sizes.

The inventive napkin holder also holds and dispenses flattened, conical coffee filters.

From the foregoing it will be seen in its most essential aspect the present invention is a napkin holder, including a base having a generally planar bottom adapted for placement on a flat horizontal surface, first and second substantially parallel opposing vertical sides connected to and extending vertically upward from the base and substantially perpendicular to the planar bottom, first and second inclined opposing sides disposed between and connecting the first and second vertical sides, wherein the first and second inclined sides converge at their respective bottom ends and terminate at the base to form a V-shaped trough enclosed by the first and second vertical sides.

Seen in another aspect the present invention will be understood to be a napkin holder configured to support and display a stack of napkins in a splayed array, having a base member, first and second opposing vertical sides, first and second opposing inclined sides disposed between and connecting the first and second opposing vertical sides, and inclined sides tapering inwardly from top to bottom such that the inclined sides converge to form a V-shaped trough closed by the first and second opposing vertical sides.

As seen in a final aspect the present invention will be understood to be a napkin holder, having a base, a plurality of sides connected to the base and extending upwardly therefrom, the sides configured to induce rotation of a napkin in a stack of napkins dropped in a vertical orientation into the holder, the rotation proceeding a first direction on one side of the napkin stack and in an opposing direction on the other side of the napkin stack, such that the individual napkins are at least partially displaced from one another and presented in a fanned array, thereby facilitating selection and removal of individual napkins.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A napkin holder, comprising:

a base having a generally planar bottom adapted for placement on a flat horizontal surface;

first and second substantially parallel opposing vertical sides connected to and extending vertically upward from said base and substantially perpendicular to said planar bottom; and first and second inclined opposing sides disposed between and connecting said first and second vertical sides, wherein said first and second inclined sides converge at their respective bottom ends and terminate at said base to form a V-shaped trough enclosed by said first and second vertical sides;

wherein the convergence of said first and second inclined sides and the connection of said first and second inclined sides to said first and second vertical sides forms two obtuse angles at a first pair of diagonally opposing corners and two acute angles at another pair of diagonally opposing corners.

2. The napkin holder of claim 1, wherein said first and second inclined sides include a friction surface.

3. The napkin holder of claim 2, wherein said friction surface is formed by an abrasive substance.

4. The napkin holder of claim 2, wherein said friction surface is formed by rubber.

5. The napkin holder of claim 2, wherein said friction surface is a textured surface incorporated into and integral with said first and second inclined sides.

6. The napkin holder of claim 1, including a plurality of V-troughs.

7. The napkin holder of claim 6, wherein said plurality of V-troughs have different sizes so as to accommodate napkins of different sizes.

8. The napkin holder of claim 1, further including apertures on said first and second vertical sides.

9. The napkin holder of claim 8, wherein each of said apertures includes a bottom edge extending outwardly from its respective vertical side.

10. A napkin holder configured to support and display a stack of napkins in a splayed array, comprising:

a base member;

first and second opposing vertical sides;

first and second opposing inclined sides disposed between and connecting said first and second opposing vertical sides, said inclined sides tapering inwardly from top to bottom such that said inclined sides converge to form a V-shaped trough closed by said first and second opposing vertical sides;

wherein the corners formed by the connection of said opposing inclined sides and said opposing vertical sides include two obtuse angles at a first pair of diagonally opposing corners and two acute angles at another pair of diagonally opposing corners.

11. The napkin holder of claim 10, wherein a napkin stack comprising square napkins dropped into said napkin holder falls until the stack comes into contact with said first and second inclined sides, and wherein said first and second inclined sides induce rotation of napkins in opposing directions so as to splay the napkins into a fanned arrangement.

12. The napkin holder of claim 11, wherein napkins are urged into an orientation relative to one another that is slightly displaced from one another so as to facilitate removal of a single napkin from the napkin stack in said holder.

13. The napkin holder of claim 10, wherein said first and second opposing inclined sides include a friction surface.

14. The napkin holder of claim 13, wherein said friction surface comprises material applied to an upper surface of said first and second opposing inclined sides.

15. The napkin holder of claim 13, wherein said friction surface comprises surface features integral with the material from which said first and second opposing inclined sides are fabricated.

* * * * *